United States Patent [19]

van der Sterren et al.

[11] Patent Number: 5,021,836

[45] Date of Patent: Jun. 4, 1991

[54] METHOD AND DEVICE FOR TRANSFERRING TWO IMAGES TO DIFFERENT SIDES OF A RECEIVING SHEET

[75] Inventors: Martin L. van der Sterren, Roermond; Julius V. C. Graswinckel, Arcen, both of Netherlands

[73] Assignee: Oce-Nederland B.V., Netherlands

[21] Appl. No.: 507,654

[22] Filed: Apr. 10, 1990

[30] Foreign Application Priority Data

Apr. 13, 1989 [NL] Netherlands ..... 8900921

[51] Int. Cl.[5] ..... G03G 15/14

[52] U.S. Cl. ..... 355/281; 355/272; 355/319

[58] Field of Search ..... 355/281, 280, 279, 278, 355/277, 272, 273, 271, 212, 319; 430/126

[56] References Cited

U.S. PATENT DOCUMENTS 3,519,344 7/1970 Clark et al. ..... 355/271

FOREIGN PATENT DOCUMENTS 0147157 11/1981 Japan ..... 355/271
0138669 8/1982 Japan ..... 355/271
0095568 5/1987 Japan ..... 355/271

*Primary Examiner*—A. T. Grimley
*Assistant Examiner*—Thu Anh Dang
*Attorney, Agent, or Firm*—Reed Smith Shaw & McClay

[57] ABSTRACT

A method and means for transferring two images substantially simultaneously and directly to different sides of a receiving sheet, wherein the images are formed one behind the other on an endless belt trained about support rollers. An image transfer zone in the form of a loop between the transport rollers is formed in the belt via a guide roller, thereby bringing the two image towards one another. During transfer of the images to the receiving sheet, the direction of rotation of one of the transport rollers is reversed.

8 Claims, 5 Drawing Sheets

METHOD AND DEVICE FOR TRANSFERRING TWO IMAGES TO DIFFERENT SIDES OF A RECEIVING SHEET

FIELD OF THE INVENTION

The invention relates to a method and means of transferring two images situated one behind the other on a moving image support to different sides of a receiving sheet and, in particular, to a method where the two images are transported substantially simultaneously with a receiving sheet through an image transfer zone formed between the beginning and end of support loop for the transfer of the images to different sides of said receiving sheet.

BACKGROUND OF THE INVENTION

A method and device for transferring images to different sides of a receiving sheet are known. For Example, in European Patent Application 0,222,224, images are placed on opposite sides of the support for transfer to different sides of a receiving sheet. In U.S. Pat. No. 3,672,765, on the other hand, images are transferred from the same side of the support and placed on the opposite sides of the receiving sheet in seriatim.

Another method and device are disclosed in the journal Research Disclosure of November 1984, No. 24708. In this device the leading image of two images situated on a photoconductive belt advanced by a transport roller is transferred, in an image transfer zone, to a first image transfer roller brought into rolling contact with the photoconductive belt. The image is then transferred to a second image transfer roller brought into rolling contact with the first image transfer roller. The first image transfer roller is then moved away and the second image transfer roller is brought into rolling contact with the photoconductive belt in the image transfer zone. A receiving sheet is then fed through the image transfer zone for transfer of the leading image from the second image transfer roller to one side of the receiving sheet and simultaneously therewith the transfer of the trailing image of the two images on the photoconductive belt from the latter directly to the other side of the receiving sheet.

The image on one side of the receiving sheet has thus undergone two image transfer steps more than the image on the other side of the receiving sheet. Since each image transfer step is accompanied by a loss of image quality, there is, therefore, a difference in quality between the images transferred to the different sides of the receiving sheet. This device also has the disadvantage that because the image transfer which takes place is always incomplete, the two image transfer rollers have to be repeatedly cleaned, in addition to the photoconductive belt, to prevent transfer of a ghost image to a following receiving sheet.

Accordingly, it is an object of the present invention to provide a method and device without these disadvantages.

SUMMARY OF THE INVENTION

The first part of the image support downstream of the location of the leading edge of one of the images and a second part of the image support upstream of the location of the trailing edge of the other image are brought together by means of the formed loop. Generally, the present invention comprises forming a loop in the image support means so that the images are brought towards one another, with or after formation of a loop in the image support, to form the image transfer zone and in that during the formation of the image transfer zone the direction of transport of one of the two image support parts is reversed.

Consequently, two images are transferred directly from the image support to different sides of a receiving sheet, while at the same time two images disposed in the same orientation one behind the other on the image support also come on different sides of the receiving sheet in the same orientation.

In a device which comprises an image support in the form of a belt, there is at least a first and a second transport roller which are positioned against the side which does not carry any image and a drive means for moving the image support. The invention provides that the first transport roller is mounted on first displacement means by means so that the roller can be brought into one of two positions: a first position in which the roller is at some distance from the second transport roller, and a second position in which the roller is pressed, with intermediate parts of the image support, against the second transport roller (to form a transfer zone). A loop-forming member and a second displacement means for moving the loop-forming member are provided to form a loop and/or vary the size of the loop at the image support region which is situated between the first transport roller and the second transport roller.

Consequently, two images situated one behind the other on the image support belt are transferred simultaneously in the same orientation to different sides of a receiving sheet which, in the second position of the transport rollers, moves at the same speed as the first part and the second part of the image support through the image transfer zone. Other features and advantages of the invention will be explained in the following description of two embodiments of a device according to the invention with reference to the accompanying drawings.

PRESENTLY PREFERRED EMBODIMENT

Figure 1:
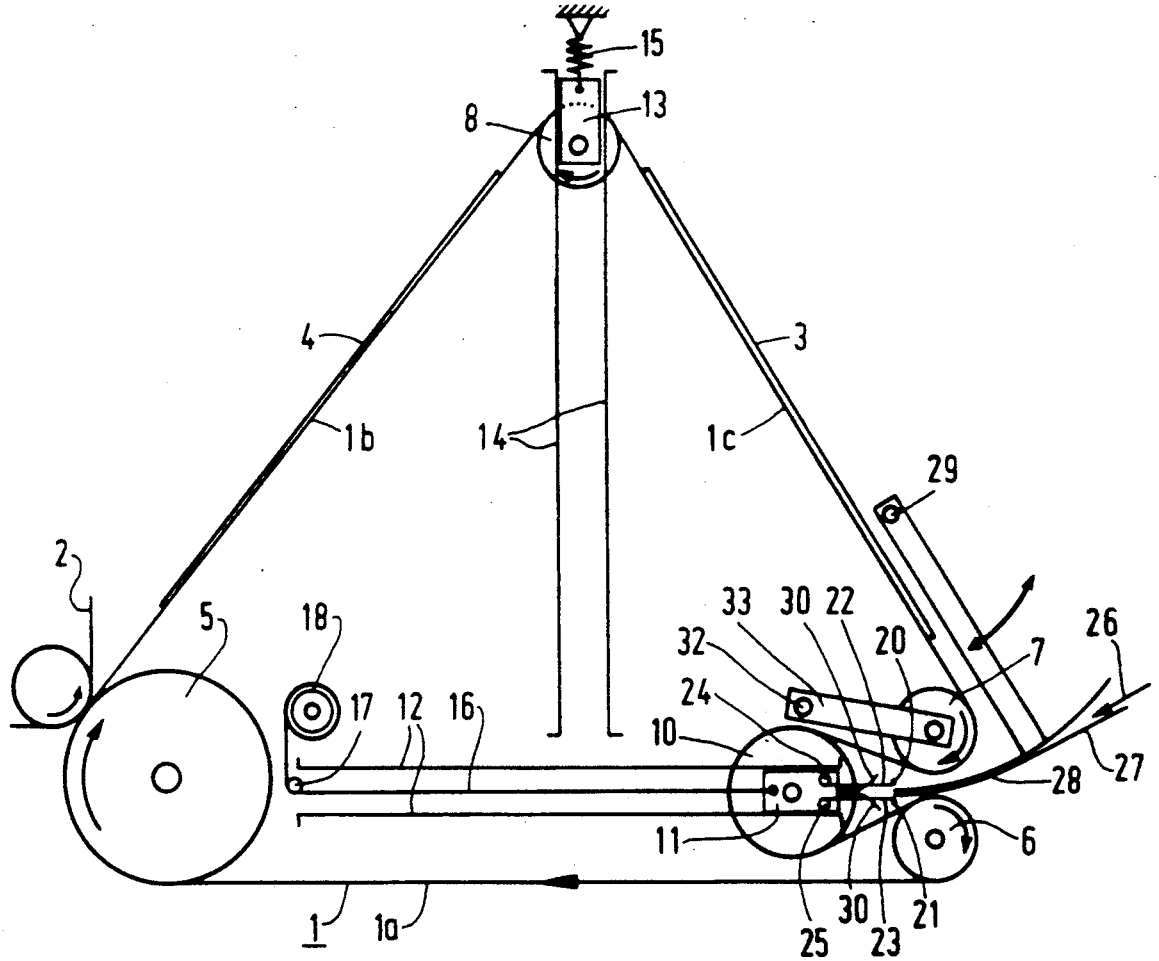
FIG. 1 is a diagrammatic cross-section of a first embodiment of a device according to the invention shown in a first position.

The device shown in FIG. 1 comprises an endless belt 1 to which powder images can be applied at regular intervals from one another by transfer of powder images formed on a photoconductive belt 2. Two such transferred powder images are denoted by references 3 and 4. The formation of powder images on the photoconductive belt 2 and the transfer thereof to the endless belt 1 may be effected in a manner described in U.S. Pat. No. 4,068,937.

Endless belt 1 is trained about a transport roller 5 which is drivable at a constant speed and is disposed at a fixed location, and also about a freely rotatable transport roller 6, which is also disposed at a fixed location, about a transport roller 7 disposed near transport roller 6, and about a freely rotatable tension roller 8.

A freely rotatable disc roller 10 is disposed in the space enclosed by rollers 5, 6, 7 and S, its discs being in contact only with edge zones of the image-carrying side of endless belt 1. Endless belt 1 thus forms a loop which extends from the transport roller 7 via the disc roller 10 to the transport roller 6 as shown in FIG. 1. At the ends the disc roller 10 is mounted in a first yoke 11 which can be moved back and forth in linear guides 12. Each linear guide 12 extends in a direction parallel to the direction of movement of part 1*a* of endless belt 1 between rollers 5 and 6. Tension roller B is mounted at the ends in a second yoke 13 which can be moved back and forth in linear guides 14 extending in the central perpendicular plane of belt part 1*a*. A tension spring 15 engaging second yoke 13 tends to hold endless belt 1 in the position shown in FIG. 1.

One end of a cord 16 is secured to first yoke 11. Cord 16 is trained about a guide roller 17 at the end of the linear guides 12 and then extends to a reel 18. The other end of cord 16 is secured to reel 18. Reel 18 can be driven by drive means (not shown) in order to wind cord 16 thereon. In these conditions, first yoke 11 with disc roller 10 mounted therein moves along the linear guides 12 in the direction of the transport roller 5, the loop formed in the endless belt 1 thus increasing, and the second yoke 13 with the tension roller 8 mounted therein moves against the action of the spring 15 along the linear guides 14 in the direction of the linear guides 12, the belt part 1*b* which extends between the transport roller 5 and the tension roller 8 being shortened, as is also the belt part 1*c* extending between tension roller 8 and transport roller 7. Spring 15 keeps the continuously advancing endless belt 1 permanently taut in these conditions.

Two rods 20 and 21 are disposed within the space enclosed by the loop in endless belt 1, near transport rollers 6 an 7, at a short distance from one another. One end of a wire 22 and 23, respectively, is secured to each rod. Two wire reels 24 and 25 are rotatably secured to the first yoke 11. The other end of the wire 22, 23 respectively is secured to the wire reel 24, 25 respectively. The wire reels 24 and 25 are spring biased to keep the wires 22 and 23 taut between rods 20 and 21 and wire reels 24 and 25. These wires form a guide for receiving sheet 26 introduced therebetween.

Figure 2:
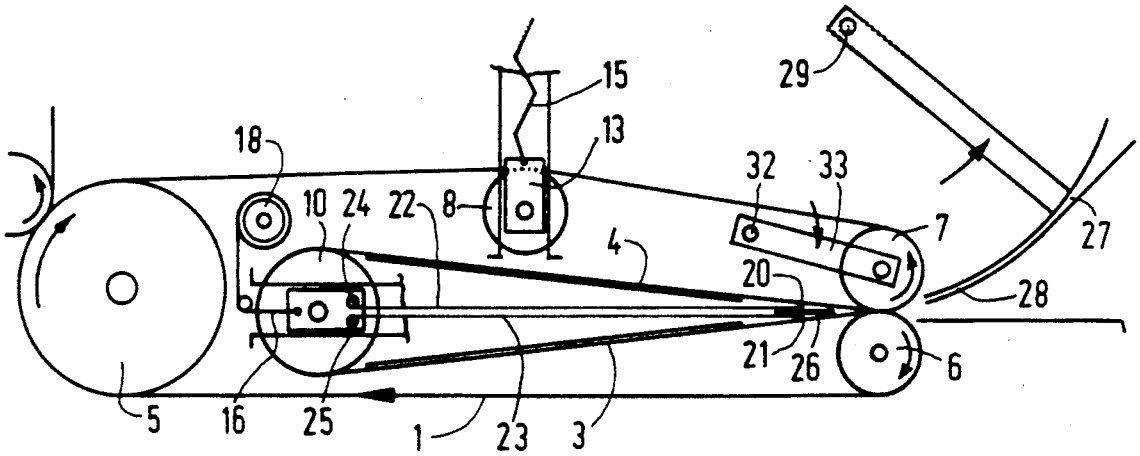
FIGS. 2 and 3 show the device according to FIG. 1 in a second position, but in different stages.

A sheet entry guide 27 provided with an end 28 formed as a nozzle is rotatably secured about a shaft 29 and can occupy a position in which the nozzle 28 extends between the transport rollers 6 and 7 as far as the space between the rods 20 and 21 and a position in which the entry guide is completely outside the space enclosed by the loop in the endless belt, as shown in FIG. 2.

First yoke 11 is provided with two leaf springs 30, which form a clamp and which retain the leading edge of a receiving sheet 26 at first yoke 11, such sheet 26 having been introduced via the sheet entry guide 27 and the nozzle-shaped end 28 thereof.

The ends of transport roller 7 are mounted in arms 33 rotatable about a shaft 32, which arms 33 can occupy a first position shown in FIG. 1, in which the transport roller 7 is at some distance from the transport roller 6, and a second position in which transport roller 7 is in pressure contact with transport roller 6 to form an image transfer zone therebetween.

The operation of the device shown in FIG. 1 will now be explained by reference to FIGS. 1 to 3. which illustrate the device in consecutive working stages.

Beginning with the stage shown in FIG. 1, images 3 and 4 required to come on different sides of a receiving sheet are situated at the indicated locations on endless belt 1. In this stage, a receiving sheet 26 is introduced, via the sheet entry guide 27 and the nozzle-shaped end 28 thereof, to a position between the guide formed by the unreelable wires 22 and 23, respectively, until the leading edge of the receiving sheet 26 is clamped by leaf springs 30. The drive of cord reel 18 is then switched on so that cord 16 pulls first yoke 11 in the direction of roller 5. In doing so disc roller 10 and tension roller move into the position shown in FIG 2.

Since endless belt 1 constantly advances at the same speed by means of the driven transport roller 5, images 3 and in the stage reached in FIG. 2 are situated on the belt parts which extend between disc roller 10 and transport roller 6, and between transport roller 7 and disc roller 10, respectively. Receiving sheet 26 is situated between unreeled wires 22 and 23 which are in turn situated between the two images.

Like entry guide 27, wire guide 22 and 23, respectively, prevents a receiving sheet from coming prematurely into contact with the endless image-carrying belt 1.

Once the sheet entry guide 27 has swung into the position shown in FIG. 2 after the receiving sheet has been clamped by leaf springs 30, in which position the sheet entry guide no longer extends between the transport rollers 6 and 7, arm 33 is rotated to move transport roller 7 towards transport roller 6 to form an image transfer zone therebetween. Cord reel 18 is then disconnected from its drive and spring 15 pulls endless belt 1 back to the initial position shown in FIG. 1. During this movement, transport roller 7, by frictional contact with transport roller 6 via the belt parts situated therebetween, assumes a direction of rotation opposed to its original direction of rotation, which original direction was the same as the direction of rotation of transport roller 6 and transport roller 5 driven at constant speed. In doing so the receiving sheet is fed through the image transfer zone formed by transport rollers 6 and 7, images 3 and being simultaneously transferred from the endless belt 1 to different sides of receiving sheet 26 and the receiving sheet being discharged as shown in FIG. 3.

In the above-described device, the edge part of the receiving sheet 26 which, when a loop of minimal size is formed, is situated between the image transfer nip and the clamped edge of the sheet, remains unprinted. Printing of that part can be obtained, if a compression spring is disposed between first yoke 11 and a part carrying leaf springs 30, and a stop disposed near rods 20 and 21, that part which carries the leaf springs abutting against the stop just before the yoke 11 reaches the first position. Thereafter, receiving sheet 26 together with image support 1 moves entirely through the image transfer nip that has been formed, the compression spring being compressed.

Figure 4:
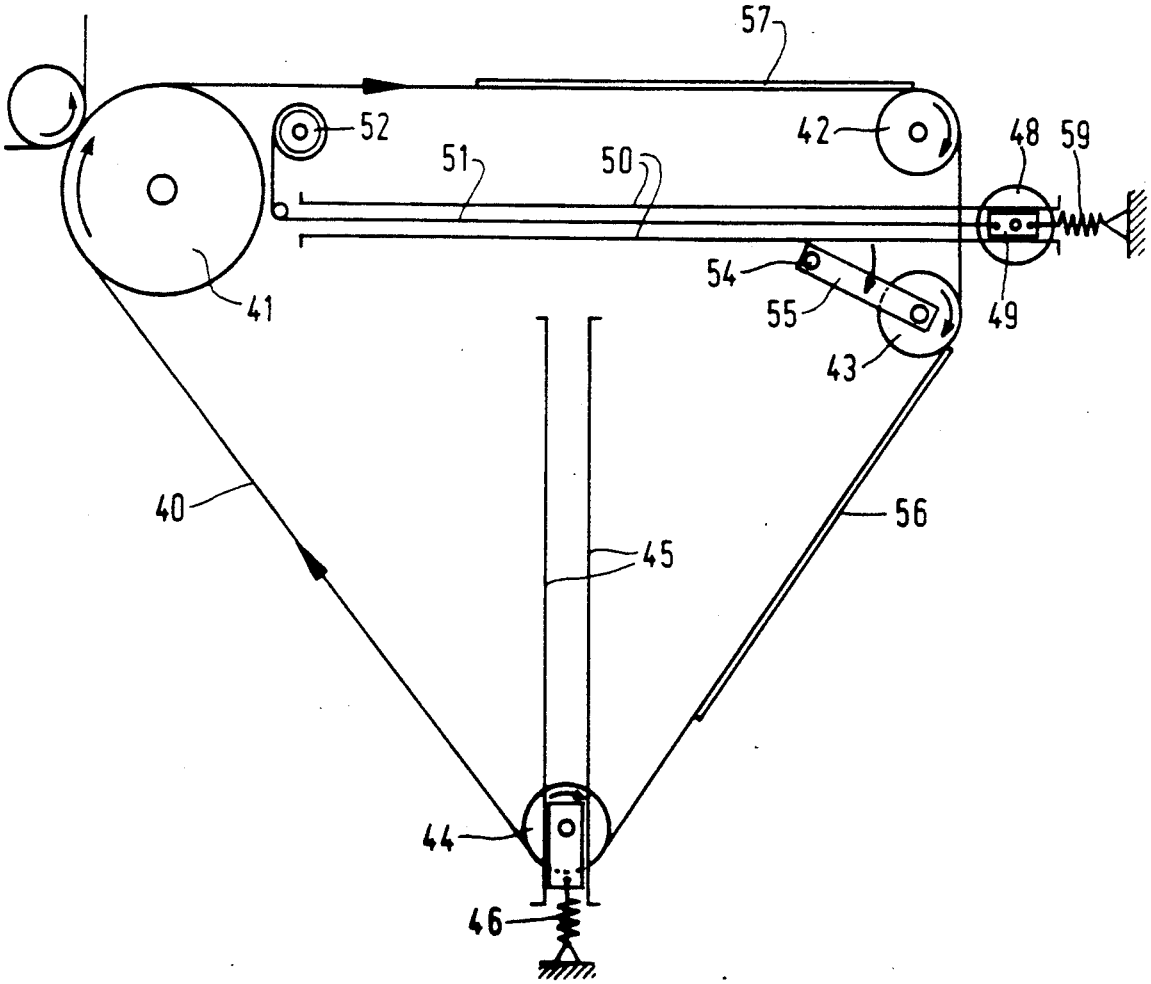
FIG. 4 is diagrammatic cross-section of a second embodiment of a device according to the invention shown in a first position.

In the device shown in FIG. 4, endless belt 40 which may be the same as belt 1 in the device described hereinbefore, successively runs about a transport roller 41 drivable at constant speed, about freely rotatable transport rollers 42 and 43, and about a tension roller 44. Like tension roller 8 in the device described herein before, tension roller 44 is contained in a linear guide 45 and is held by a spring 46 in the initial position shown in FIG. 4. A guide roller 48 is mounted in a yoke 49 contained in a linear guide 50 extending from transport roller 41 to past transport rollers 42 and 43. In the initial position guide roller 48 is at a location which is situated on that side of the transport rollers 42 and 43 which is remote from the transport roller 41.

The ends of transport roller 43 are mounted in arms 55 rotatable about a shaft 54, which arms 55 can occupy a first position shown in FIG. 4, in which transport roller 43 is at a distance from transport roller 42 such that guide roller 48 can move therebetween to form a loop in endless belt 40, and a second position in which transport roller 43 is in pressure contact with transport roller 42 to form an image transfer zone between the enclosed parts of endless belt 40.

A cord 51 is secured to the yoke 49 and extends via linear guide 50 to a reel 52 on which the cord can be wound to move guide roller 48 in the direction of transport roller 41.

The operation of the device shown in FIG. 4 is explained with reference to FIGS. 4 to 6, which show the device in consecutive working stages. The first stage is that shown in FIG. 4, in which images 56 and 57 are situated on endless belt 40 at the locations indicated.

Figure 5:
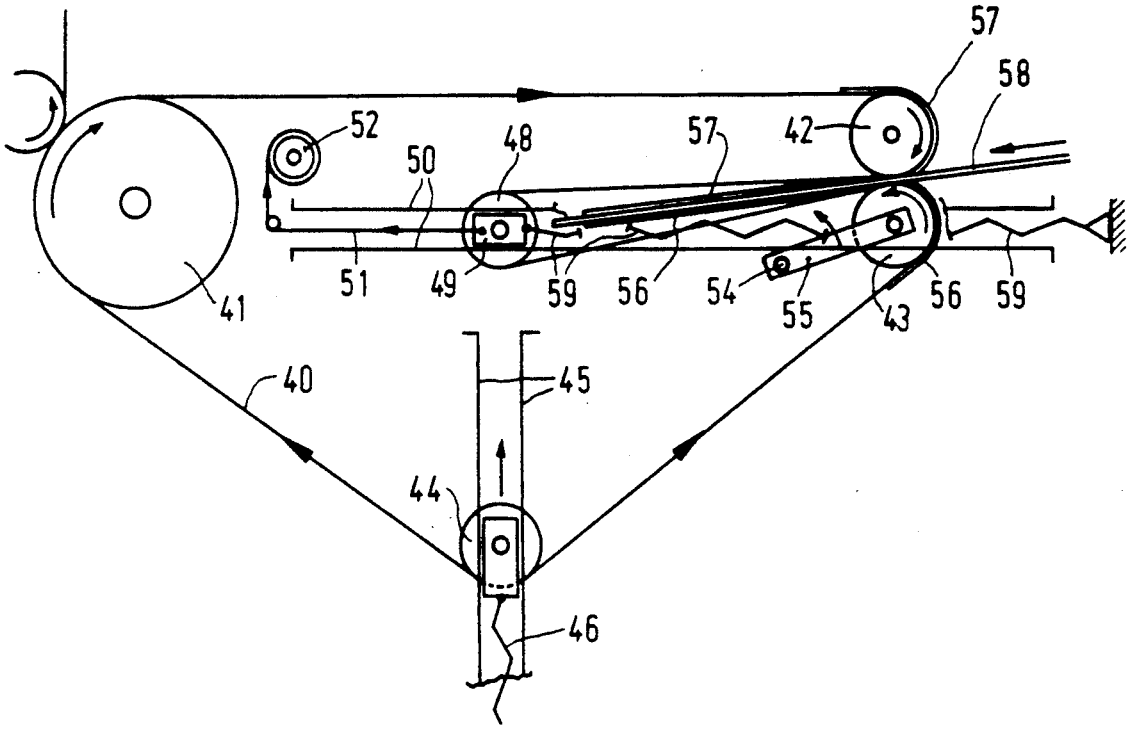
FIGS. 5 and 6 show the device according to FIG. 4 in a second position, but in different stages.
Figure 6:
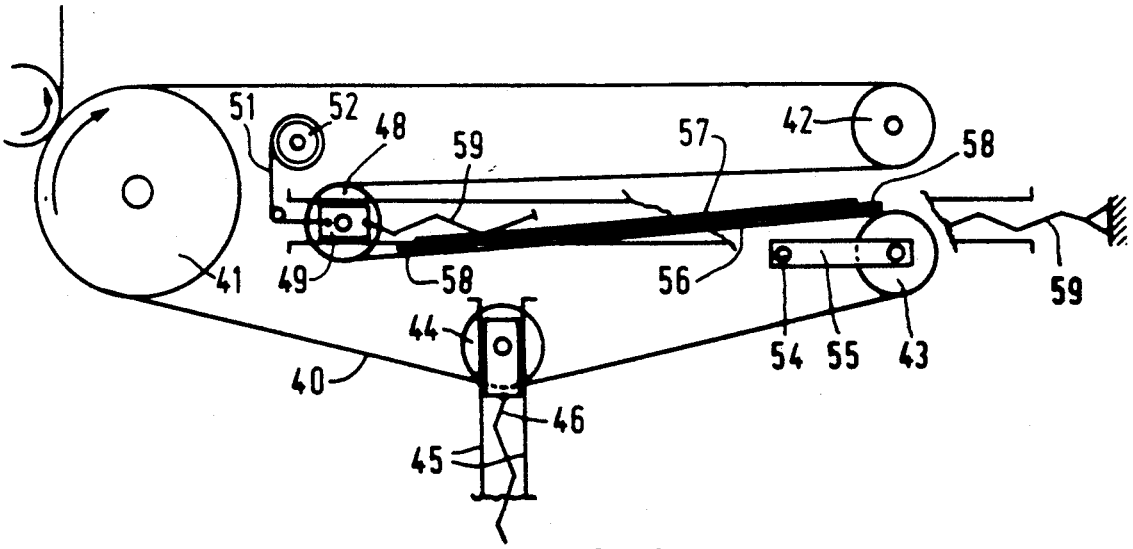

In this stage the drive for cord reel 52 is switched on, cord 51 pulling yoke 49 with guide roller 48 in the direction of roller 41 against the action of spring 46 until guide roller 48 and tension roller 44 occupy the position shown in FIG. 6. On movement of guide roller 48 from the position shown in FIG. 4, the roller stays in contact with a zone of endless belt 40 situated between image parts 56 and 57. After guide roller 48 has passed transport rollers 42 and 43, arm 55 is turned to move transport roller 43 to transport roller 42 to form an image transfer zone therebetween. Directly thereafter a receiving sheet 58 is fed into the image transfer zone formed between folded endless belt 40 and images 56 and 57 are simultaneously transferred to different sides of receiving sheet 58 as shown in FIG. 5.

On reaching the stage shown in FIG. 6, in which the image transfer is complete, arm 55 is turned back to disengage transport rollers 42 and 43 again, whereafter cord reel 52 is disengaged and spring 46 pulls endless belt 40 and a spring 59 pulls guide roller 48 back into the initial position shown in FIG. 4, receiving sheet 58 which lies on the bottom part of the looped belt part being discharged.

In the embodiment shown in FIGS. 4 to 6, the loop-forming roller can come into contact with the endless belt over the entire width without disturbing any images on this belt. The advantage of this is that a belt of soft material, e.g. a silicone rubber belt, can be used for the endless image transfer belt. Another advantage is that the images are transferred during the formation of the loop in the belt, thus eliminating the risk of the receiving sheet coming prematurely into contact with the images, and this does away the need for a sheet guide within the loop. However, the embodiment shown in FIGS. 4 to 6 is suitable only for cases in which the receiving sheet readily detaches from and hence does not adhere to the belt after the simultaneous transfer of images thereto.

Figure 3:
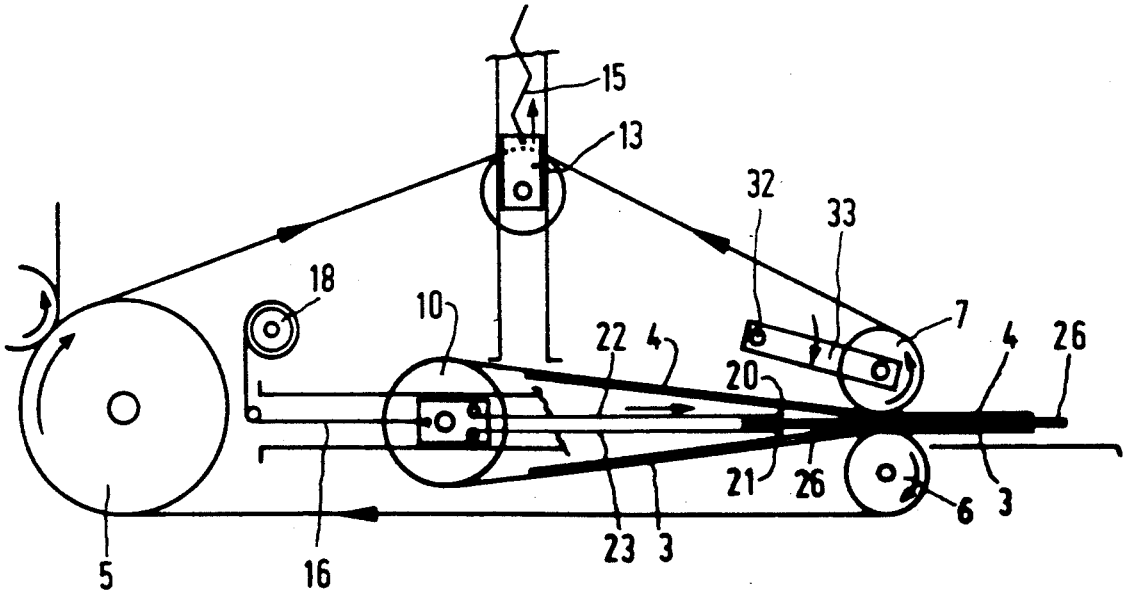

In the embodiment shown in FIGS. 1 to 3 the risk of such adhesion is much less because in this case the images are transferred when the receiving sheet leaves the loop. In that situation the directions of movement of the belt parts after the image transfer zone diverge considerably. The advantage of the embodiment shown in FIGS. 1 to 3, the ready separation of the receiving sheet and endless belt after the image transfer zone, and the advantage of the embodiment shown in FIGS. 4 to 6, the use of a soft endless belt in which an uninterrupted guide roller forms a loop, can both be embodied in an embodiment which forms a modification of the device shown in FIGS. 1 to 3.

Figure 7:
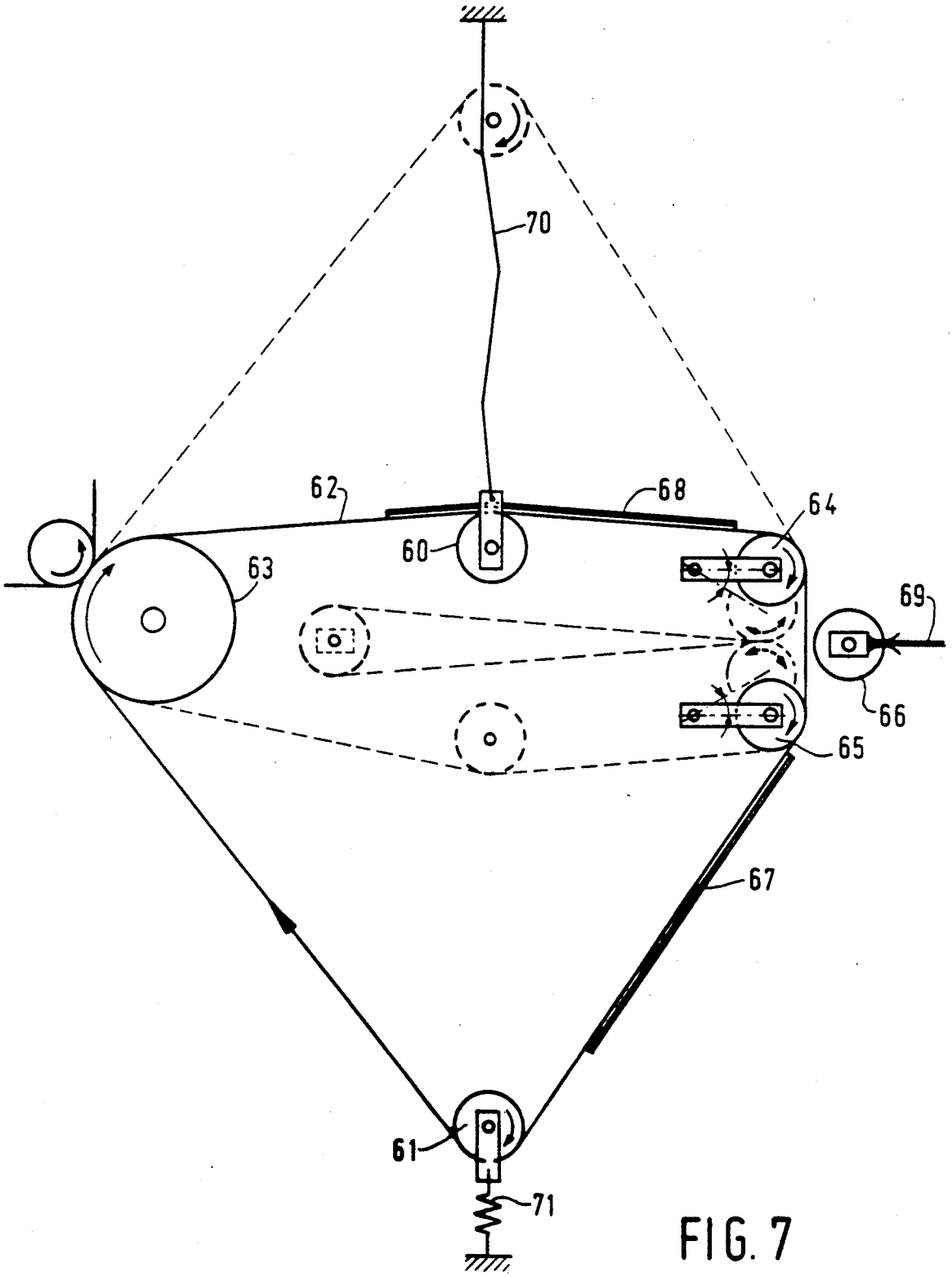
FIG. 7 is a diagrammatic cross-section of another embodiment device according to the invention shown in the first p with full lines and in the second position with broken lines.

In this modification, shown in FIG. 7, tension rollers 60 and 81 are provided at the part of the endless belt 62 between transport rollers 63 and 64 and at the part of the endless belt between transport rollers 63 and 65, respectively, and hold both belt parts in a starting position which corresponds to the starting position shown in FIG. 4. From this starting position, a guide roller 66, corresponding to guide roller 48 in FIG. 4, applies the loop, the guide roller 66 remaining in contact with a part of the endless belt 62 situated between two images 67 and 68 on the belt 62 and simultaneously therewith a receiving sheet 69 is fed into the loop in the manner described with reference to FIGS. 1 to 3. Then the transport rollers 64 and 65 are pressed to each other and the loop is pulled away again by tension spring 70 acting on tension roller 60, thereby simultaneously transferring the images 67 and 68 to different sides of the receiving sheet 69, which sheet then readily detaches from the endless belt 62. The endless belt 62 is then reset to the starting position by means of spring 71 acting on tension roller 61.

In the embodiment described in which a receiving sheet is first fed within the loop and then provided with images, it is possible to bring the receiving sheet into the loop, after it has formed, from a side edge of the endless belt.

While presently preferred embodiments of the invention have been shown and described in particularity, the invention may be otherwise embodied within the scope of the appended claims.

What is claimed is:

1. A method of transferring two images to different sides of a receiving sheet, said method comprising forming said images on a moving image support such that one of said images is located behind the other of said images, each of said images thus having a leading edge and a trailing edge relevant to the motion of said image support, said method further comprising forming a loop with said image support to define an image transfer zone, by bringing together a first part of said image support downstream of the location of the leading edge of one of said images and a second part of the image support upstream of the location of the trailing edge of the other of said images, said images being transported substantially simultaneously with a receiving sheet through said image transfer zone for transferring of the images to different sides of said receiving sheet wherein the direction of motion of one of said first image support part and said second image support part is reversed during image transfer.

2. A device for transferring two images on a moving image support to different sides of a receiving support, said device comprising an image support belt having one side for carrying said images; at least a first transport roller and a second transport roller and drive means for moving the image support, said first support roller being mounted on first displacement means by means of which said first transport roller can be brought into one of two positions, a first position in which said first transport roller is located some distance from said second transport roller and a second position in which said first transport roller is pressed, with intermediate parts of the image support against said second transport roller to form a transfer zone, a loop-forming member and second displacement means for displacing said loop-forming member to form a loop or vary the size of a formed loop at that part of the image support which is situated between said first transport roller and the second transport roller.

3. A device according to claim 2, wherein said image support belt is an endless belt and wherein said device includes a tension roller which is in pressure contact with that side of the endless belt which does not carry an image to hold said belt taut, and including third displacement means for moving said tension roller in synchronism with said displacement of said loop-forming member.

4. A device according to claim 2, wherein said image support belt is an endless belt and wherein a tension roller is provided on the sides of said first transport roller and the second transport roller which face away from each other, said tension roller being in pressure contact with that side of the endless belt which does not carry an image to hold said belt taut, and including third displacement means for moving said tension roller in synchronism with the displacement of said loop-forming member.

5. A device according to claim 3, wherein said first transport roller is in said second position during displacement of said second displacement means from a first position in which no loop is formed to a second position in which the loop is formed of maximum size.

6. A device according to claim 3 or 4, wherein said first transport roller is in said second position during the displacement of said second displacement means from a second position in which said formed loop is of maximum size to a third position in which said loop is of minimum size.

7. A device according to claim 2, wherein said drive means for moving said image support rotate said first transport roller and said second transport roller codirectionally when said first transport roller is in said first position and rotate said first transport roller and the second transport roller in opposite directions when said first transport roller is in said second position.

8. A device according to any one of claims 2, 3, 4 or 5, wherein said loop-forming means comprise a guide roller.

* * * * *